US010738488B2

(12) United States Patent
Tan

(10) Patent No.: US 10,738,488 B2
(45) Date of Patent: Aug. 11, 2020

(54) LIFT TRUCK OPERATED STACKING FORMWORK TABLE SYSTEM AND A METHOD OF OPERATION THEREOF

(75) Inventor: Yeow Khoon Tan, Singapore (SG)

(73) Assignees: Yeow Khoon Tan, Singapore (SG); SH TECHNOLOGIES PTE LTD, Singapore (SG)

( * ) Notice: Subject to any disclaimer, the term of this patent is extended or adjusted under 35 U.S.C. 154(b) by 0 days.

(21) Appl. No.: 14/417,784

(22) PCT Filed: Jul. 27, 2012

(86) PCT No.: PCT/SG2012/000274
§ 371 (c)(1),
(2), (4) Date: Jan. 27, 2015

(87) PCT Pub. No.: WO2014/017980
PCT Pub. Date: Jan. 30, 2014

(65) Prior Publication Data
US 2015/0267422 A1 Sep. 24, 2015

(51) Int. Cl.

| | |
|---|---|
| ***E04G 19/00*** | (2006.01) |
| ***E04G 11/38*** | (2006.01) |
| ***E04G 11/48*** | (2006.01) |
| ***E04G 1/17*** | (2006.01) |

(52) U.S. Cl.
CPC ..... *E04G 19/003* (2013.01); *E04G 1/17* (2013.01); *E04G 11/38* (2013.01); *E04G 11/48* (2013.01)

(58) Field of Classification Search
CPC ..... E04G 11/38; E04G 11/48; E04G 11/52; E04G 21/14; E04G 21/142; E04G 19/003
USPC ..... 108/53.1, 53.3, 53.5
See application file for complete search history.

(56) References Cited

U.S. PATENT DOCUMENTS

| | | | | |
|---|---|---|---|---|
| 1,742,738 | A * | 1/1930 | Turner | B66F 9/06 108/53.5 |
| 2,598,730 | A * | 6/1952 | Thompson | B63C 5/02 182/113 |
| 2,632,567 | A * | 3/1953 | Richtmyer | B65G 1/0442 108/53.5 |
| 2,671,697 | A | 3/1954 | North | |
| 2,940,597 | A * | 6/1960 | Machielse | A47B 87/0215 108/53.5 |

(Continued)

FOREIGN PATENT DOCUMENTS

| | | |
|---|---|---|
| CN | 201915616 U | 8/2011 |
| CN | 102527555 A | 7/2012 |

(Continued)

OTHER PUBLICATIONS

International Search Report, dated Sep. 7, 2012 for corresponding International Application No. PCT/SG2012/000274.

(Continued)

*Primary Examiner* — Michael Safavi
(74) *Attorney, Agent, or Firm* — Intellectual Property Law Group LLP

(57) ABSTRACT

A formwork support system and a method for erecting a formwork support system are disclosed. The formwork system comprises at least one stackable truss frame, wherein the at least one stackable truss frame comprises a lifting means engagement adapted for allowing the at least one stackable truss frame to be lifted by a lifting means in use.

19 Claims, 13 Drawing Sheets

(56) References Cited

U.S. PATENT DOCUMENTS 3,157,424 A * 11/1964 Hall ..... B65G 1/0442 108/53.5
3,177,823 A * 4/1965 Entel ..... B65D 19/08 108/53.5
3,409,266 A * 11/1968 Jennings ..... E04G 11/38 182/179.1
3,506,138 A * 4/1970 Travis ..... A47B 47/03 108/189
3,620,388 A * 11/1971 Harry Mansson ... B65D 88/129 108/53.1
3,650,078 A 3/1972 Jennings
3,664,273 A * 5/1972 Howe ..... B65D 88/022 108/53.1
3,665,869 A * 5/1972 Howe ..... A47B 43/00 108/53.1
4,290,370 A * 9/1981 Gallagher ..... B65D 19/385 108/53.5
4,841,708 A 6/1989 Johnston
5,348,149 A * 9/1994 McCarthy ..... A47B 81/00 108/53.1
5,411,360 A * 5/1995 Hilliker ..... B60P 1/02 108/53.5
5,579,865 A * 12/1996 Butler ..... B66B 9/02 182/141
5,586,616 A * 12/1996 Ksenych ..... B66F 11/04 182/148
5,906,165 A * 5/1999 McCorkle, Jr. ..... B65D 19/12 108/53.1
6,135,299 A * 10/2000 Burgess ..... A47B 46/00 211/150
6,161,359 A 12/2000 Ono
6,176,463 B1 1/2001 Röck
6,343,555 B1 * 2/2002 Arai ..... B65D 19/385 108/53.5
8,002,128 B2 * 8/2011 Kern ..... B65D 19/12 211/194
8,327,775 B2 * 12/2012 Fox Harris ..... B65D 19/385 108/53.3
8,955,700 B2 * 2/2015 Barber ..... A47F 7/04 211/195
2010/0006375 A1 * 1/2010 Southworth ..... B65G 69/24 182/179.1
2010/0025563 A1 2/2010 Seng et al.

FOREIGN PATENT DOCUMENTS

ES 2360550 A1 6/2011
FR 1480197 A 5/1967
JP S 5796173 A 6/1982
JP H 06158877 A 6/1994
JP H 08284439 A 10/1996
JP 2000110368 A 4/2000
JP 4623570 B2 2/2011
KR 10-2003-0029571 4/2003
KR 10-2005-0071008 7/2005

OTHER PUBLICATIONS

Written Opinion of the ISA, dated Sep. 7, 2012 for corresponding International Application No. PCT/SG2012/000274.
Written Opinion of the IPEA, dated Sep. 1, 2014 for corresponding International Application No. PCT/SG2012/000274.
International Preliminary Report on Patentability dated Nov. 7, 2014 for corresponding International Application No. PCT/SG2012/000274.

* cited by examiner

LIFT TRUCK OPERATED STACKING FORMWORK TABLE SYSTEM AND A METHOD OF OPERATION THEREOF

FIELD OF THE INVENTION

The invention relates generally to a ceiling formwork system for building and construction, and in particular to a formwork support system and the method of operation thereof in which a series of supported formwork tables are erected at a planned height in and adjacent manner for concreting of an intermediate floor.

PRIOR ART

The conventional method for erecting a formwork table involves several procedures. For example, to determine the position of supports holding up longitudinal and transverse carriers, complex calculation tables pertaining to material composition of formwork are used. Upon marking the position, supports are then erected. During the erecting of the supports, additional equipment is used to level the support. Upon erecting the supports, a formwork table is than placed on the support for concreting. The problem with such conventional methods is that such conventional methods are labour intensive and contribute to a large number of man-hours in the building construction. Apart from the problem mentioned, such conventional methods also pose safety threats, such as falling from heights, as workers need to climb higher to erect taller supports for higher ceilings which can be more than six meters in height.

Furthermore, formwork table are often reused. Specifically, after the ceiling at the first location is concreted, the formwork tables are transported to another location within the same level or to the next level. To detach the formwork table from the concreted ceiling, the formwork table has to be lowered by adjusting the screw jack near the leg of the support using a hammer which is time consuming and wherein the hammering also may decrease the lifetime of the support. For ease of transport to the platform where the crane will hoist the formwork table to the next location, tall supports with formwork table are then tilted using a chain block to replace the jack bases with castors. The tilting of tall formwork table exposes the risk of it toppling on the workers below. In addition, the transportation of formwork tables using castors requires 4 to 5 men to transport, which further adds additional man-hour to the construction. Pushing the tall formwork table may also endanger the 4 to 5 men transporting it should it fall due to uneven ground.

Improvements to the formwork system as describe above have been established in a couple of embodiments (US 2010/0025563, U.S. Pat. No. 6,176,463). The later replaces conventional supports with a tripod supporting a stringer. Fixed positions are indicated on the longitudinal and transverse carriers for the supports which eradicate the use of complex tables. The later has basically simplified the formwork system and made the materials portable by trolleys and boxes. However, the later still requires a number of men on the job, and in addition it places workers at risk of falling whenever any installation work is above human height. For higher heights, workers still have to climb higher posing risks of fall from height.

SUMMARY

The invention was created to address or at least substantially ameliorate deficiencies of existing arrangements including by reducing man-hours and increasing safety in the construction of formwork support systems. The invention comprises of three components, the formwork table, at least one stackable truss frame and a landing gear.

The formwork support system comprises a formwork table. The formwork table comprises longitudinal beams, transverse joists spaced apart for forklift engagement and a top layer. It should be noted that the terms "forklift", "lift truck" and the like referred to herein refer to any type of forklift truck, or similar machinery adapted for lifting application.

The formwork support system further comprises at least one stackable truss frame. In the preferred embodiment, the stackable truss frame is substantially cuboid, supported by diagonal braces. A lifting means engagement is integrated at the bottom of the frame for lift truck application. The vertical support of the frame also incorporates a mechanical interlock whereby the top is the female part and the bottom is the male part, these constitute the stacking ability of the frame. The base frame is then attached with four adjustable landing legs with gearbox to ease the motion to level the formwork table. The standardizing of the width and length of the frame simplifies the formwork system, from a system which uses of complex tables for positioning to a system which only requires the motion of lifting and placing. In accordance, it eliminates possible collapse due to miscalculation of number of support or spacings between supports.

This invention is fully operated by a lift truck once assembled. When erecting a formwork table at higher height a formwork table is first attached to a frame and the adjustable landing leg is attached to another frame, to reach the planned height, a combination of frames of different height can be stacked accordingly. While this invention can be used to erect formwork table at any height, it is most advantageous for stacking at higher heights. The stacking ability of the invention coupled with it being accustomed to lift truck application, greatly reduces the number of men used in construction and also diminishes the risk of worker falling from height due to the erecting of formwork table.

The adjustable landing leg in the invention incorporates a geared mechanism, which eases adjusting the leveling and height of heavy formwork tables. The use of a landing gear can increase the lifetime of the equipment as there is no hammering which can cause dents or deformation of the equipment. In the preferred embodiment, the gear box is permanently sealed with grease for longer maintenance free operations.

The transition time and energy between dismantling of lower level formwork table to be transported for erecting of formwork table on a higher level. The dismantling of formwork table is simplified into three steps. First is to adjust the landing gear to detach from the ceiling. Secondly, as there are no locks or pins for the stacking of frames, after detachment from the ceiling, a lift truck can simply dismantle the formwork table by lifting up. Lastly, the individual components are transported to the next area where the ceiling is being concreted, or a crane platform to be hoisted to the next level.

The advantages of the invention are cost, time, manpower, safety, space storage saving. As there are no hammering, equipment lifetime is increased, thus saves cost in maintaining the equipment and labour cost. Time is saved as the transition for erecting and dismantling is greatly reduced. Heavy lifting and transportation is now done by the lift truck, thus less man-power is needed for the construction. Worker safety is enhanced since assembling of parts are done at human height and the stacking of stackable truss frame to reach the desired height is done by forklift trucks. The invention can be stripped down to individual parts which favors compact storage.

For better understanding of the invention, several exemplary components are described with reference to the enclosed drawings in the following.

DESCRIPTION OF PREFERRED EMBODIMENTS

Formwork Support System

Figure 1:
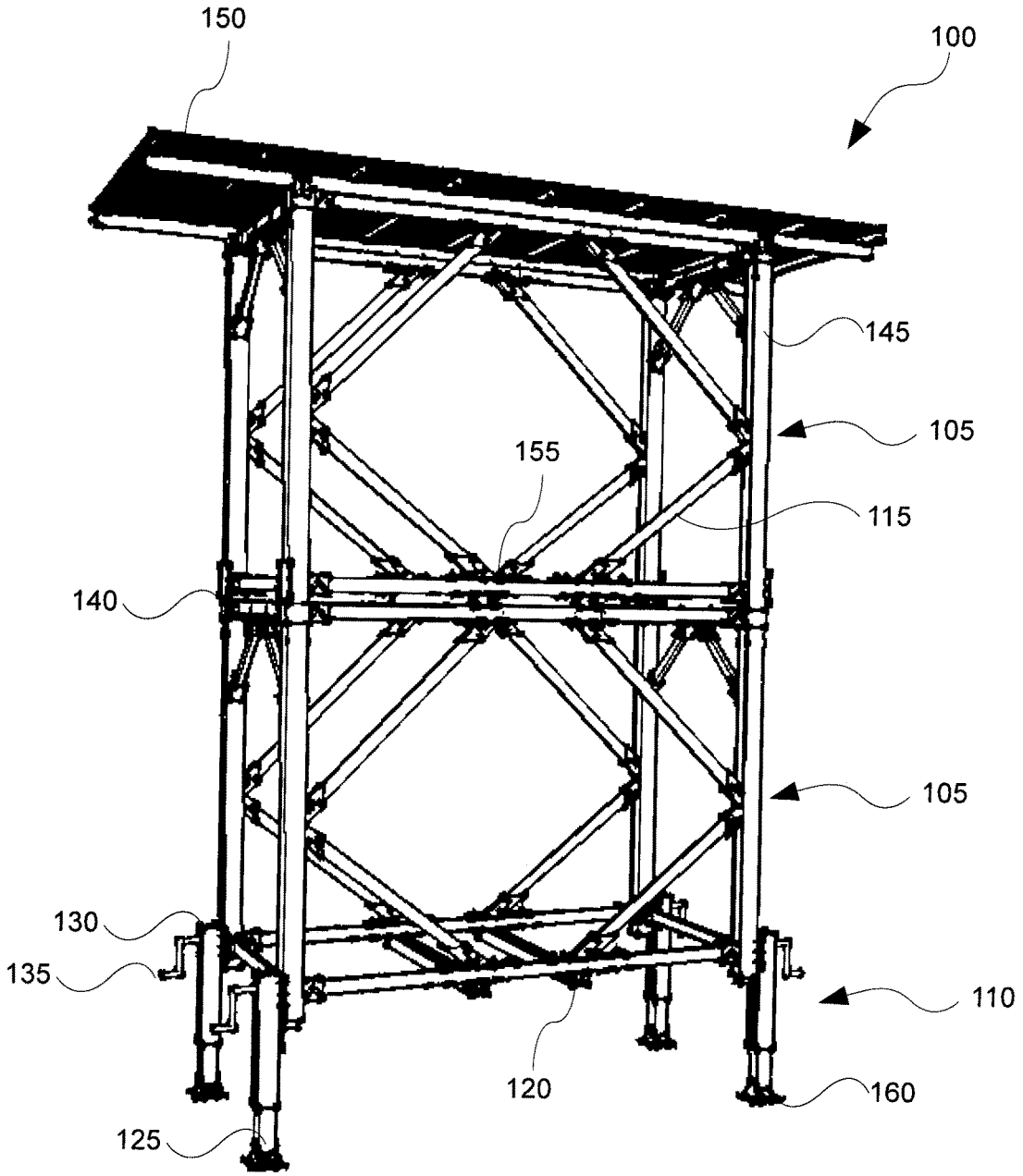
FIG. 1 shows a formwork support system in accordance with a preferred embodiment of the present invention.

Referring to FIG. 1 there is shown a formwork support system 100 for supporting formwork. The formwork support system 100 is adapted to support a formwork table 150 for supporting formwork. As is apparent from the embodiments given in FIG. 2 and FIG. 3, the formwork support system 100 is adapted for co-location with other formwork support system is so as to provide the desired coverage for the formwork table 150. Adjacent formwork support systems 100 may be coupled together in use so as to provide additional stability. Furthermore, adjacent formwork support systems 100 may be coupled together in accordance with the shape of the area to be concreted.

Figure 2:
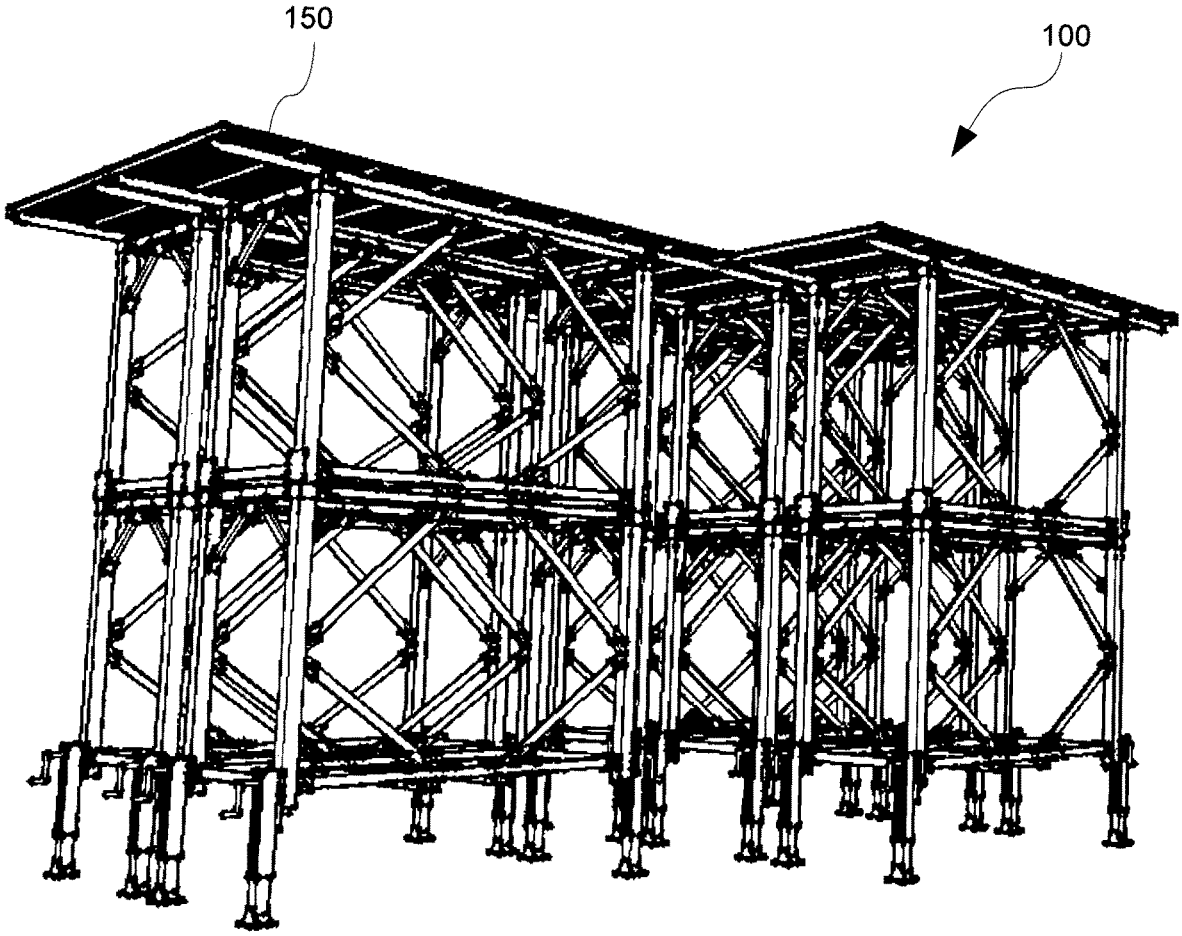
FIGS. 2 and 3 show lower and upper perspective views of a number of the formwork support systems of FIG. 1 in a co-located arrangement for the purposes of supporting a formwork support floor in accordance with a preferred embodiment of the present invention.
Figure 3:
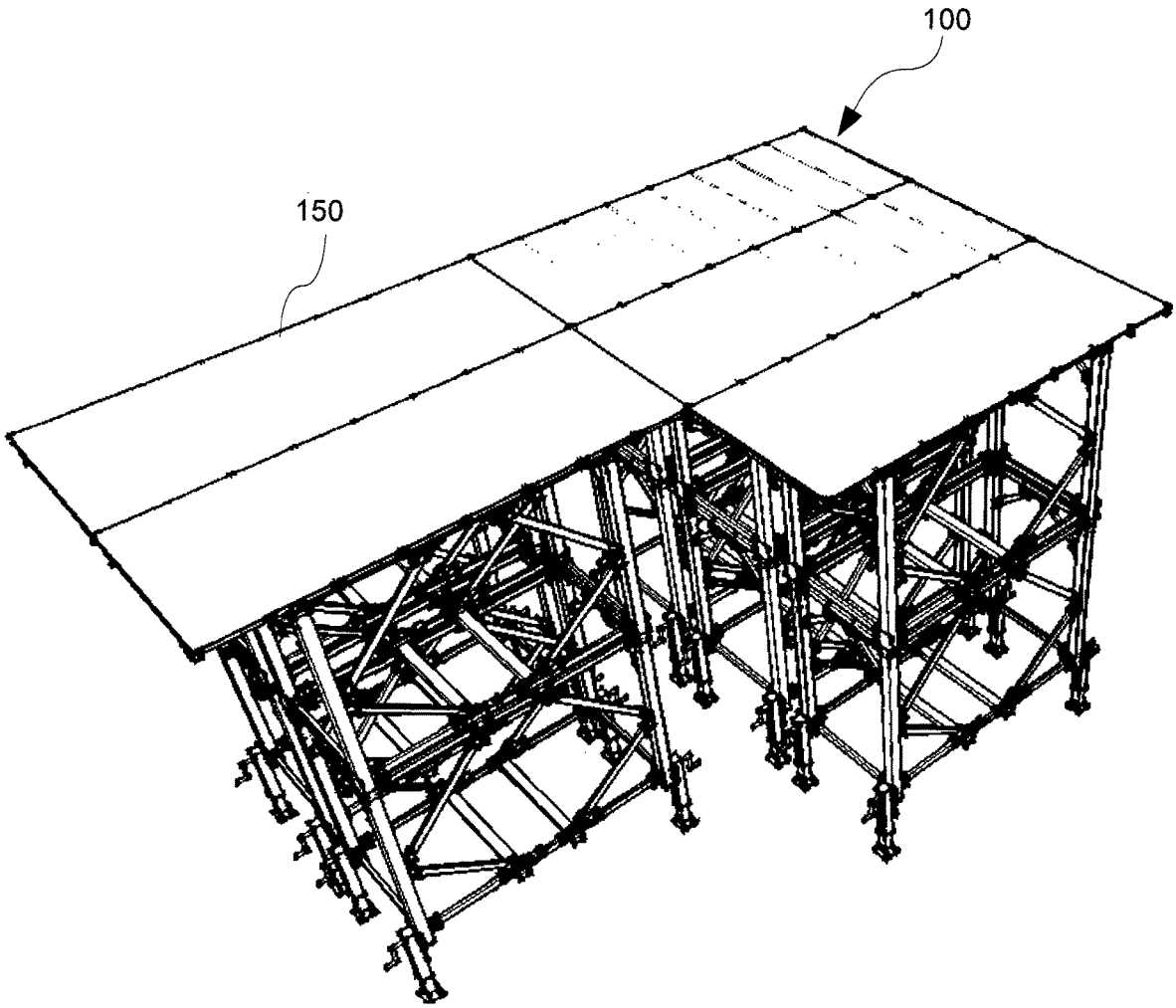

Referring to FIG. 2, there is shown a lower perspective view of co-located formwork support systems 100 and referring to FIG. 3, there is shown an upper perspective view of co-located formwork support systems 100 allocated to form a continuous formwork table 150. Typically, in use, adjoining formwork support systems 100 are coupled by transversely attached braces (such as a long pipe) for stability.

Referring again to FIG. 1, the formwork support system 100 comprises at least one stackable truss frame 105. The at least one stackable truss frame 105 is adapted for stacking such that a variable number of stackable truss frames 105 may be employed in supporting the formwork table 150 at a variable height. In this manner, should the formwork table 150 be required to be located at a greater height, more stackable truss frame 105 may be stacked to reach the desired height.

In a preferred embodiment, the stackable truss frame 105 is substantially cuboid, and comprising vertical trusses 145, horizontal trusses 155 and diagonal bracing trusses 115. The stackable truss frame 105 may be disassemblable so as to provide for on-site assembly for use and disassembly for transportation.

The stackable truss frame 105 may have varying dimensions depending on the application, but in a preferred embodiment measures 2 m width, 2 m in height, and 2 m in depth. In one embodiment, stackable truss frames 105 of the differing heights may be employed such that a stack of stackable truss frames 105 having differing heights may be employed for the purposes of attaining a specific height.

Figure 5:
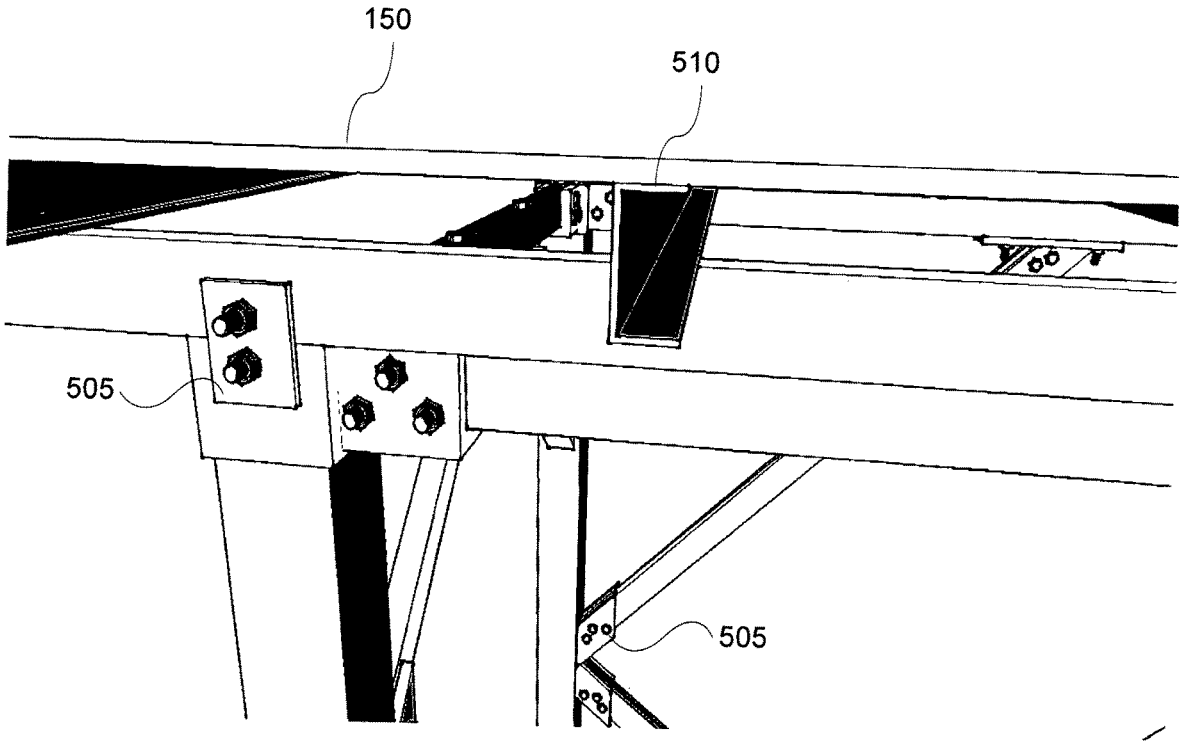
FIGS. 5 to 7 show various magnified views of the stackable truss frame of the formwork support system of FIG. 1 in accordance with a preferred embodiment of the present invention.
Figure 6:
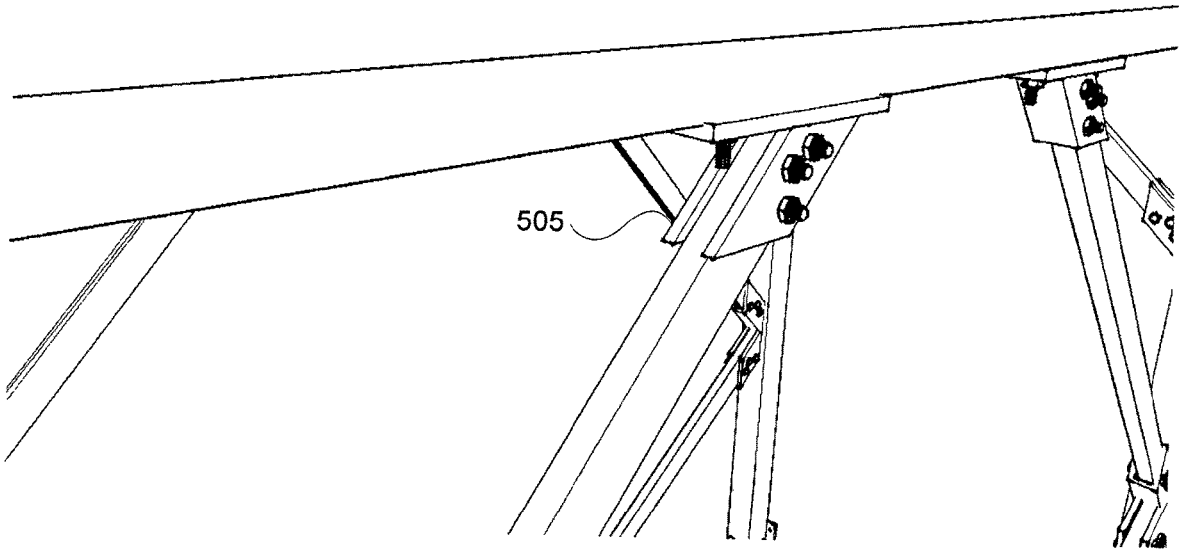
Figure 7:
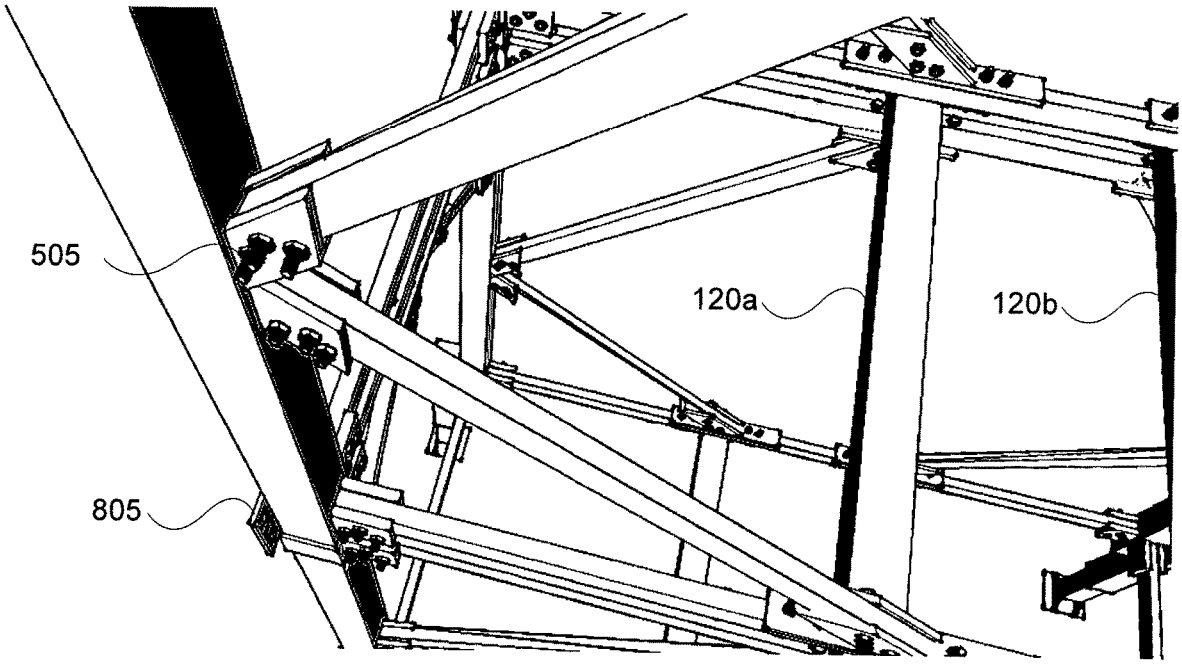

In a preferred embodiment, the stackable truss frame 105 is disassemblable. Referring to FIG. 5, there is shown fastening means 505 for fastening various portions of the stackable truss frame 105. In the embodiment shown, the fastening means 505 comprise boltable flange plates, however in other embodiments, other fastening means 505 may be employed. In this manner, using the fastening means 505, the stackable truss frames 105 may be transported in collapsed form, and constructed on-site for use in stacking.

In use, the stackable truss frame 105 may be set in place using a lifting means, such as a forklift. In one manner, a stackable truss frame 105 may be placed atop a stack of stackable truss frames 105 to reach the desired height. Alternatively, in another manner, a stack of stackable truss frames 105 may be raised by lifting means such that an additional stackable truss frame 105 may be located beneath the stack. In either manner, the stackable truss frame 105 further comprises a lifting means engagement 120 adapted for engaging a lifting means in use. Various lifting means may be used depending on the application, however in a preferred embodiment the lifting means engagement 120 is adapted for engagement by a forklift.

Figure 9:
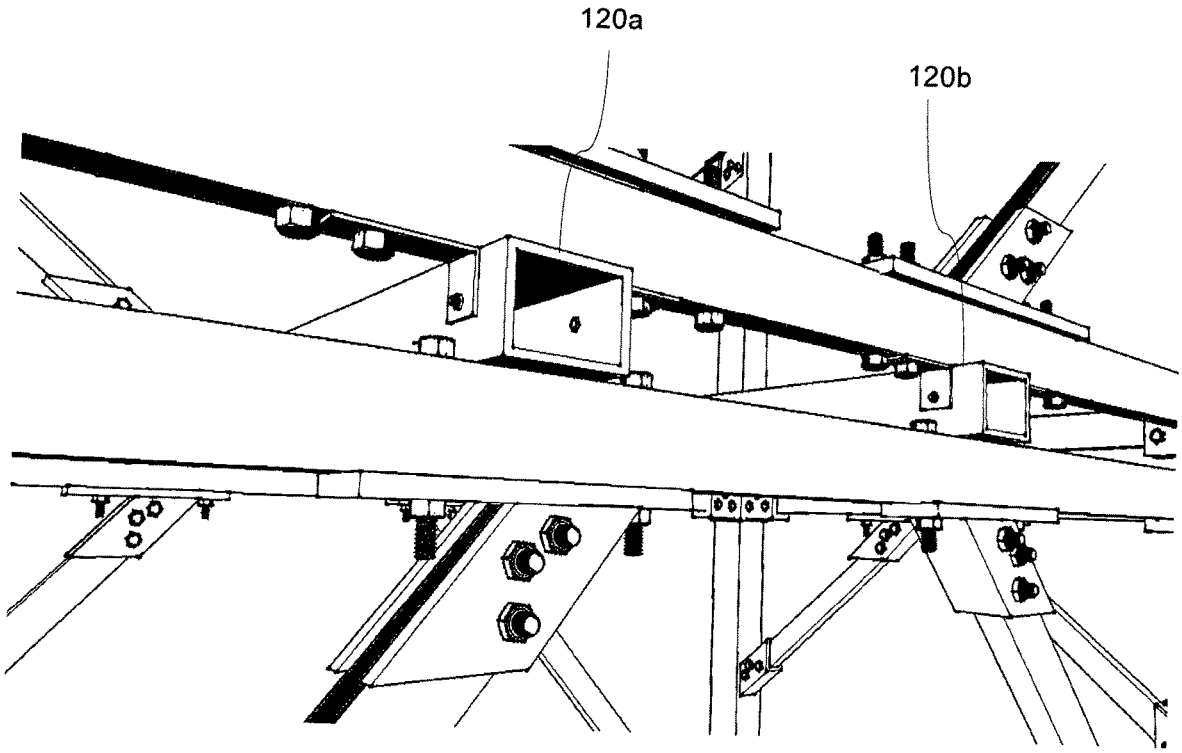
FIGS. 9 and 10 show the lifting means engagement of the stackable truss frame in further detail in accordance with a preferred embodiment of the present invention.
Figure 10:
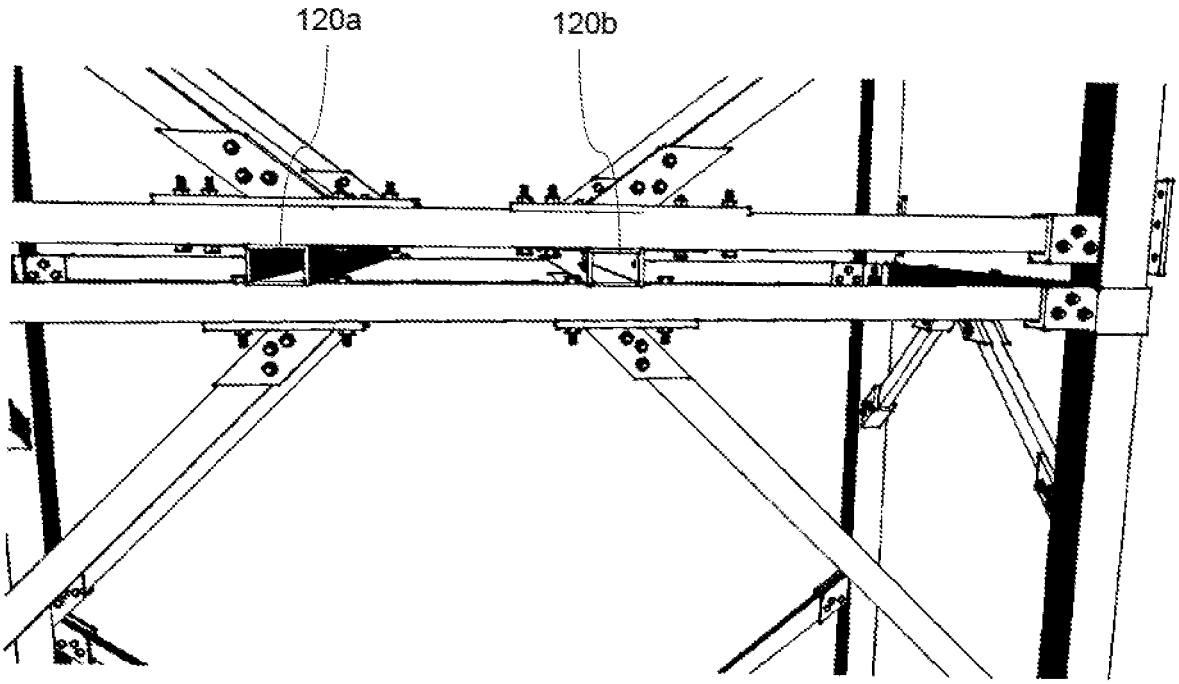
Figure 11:
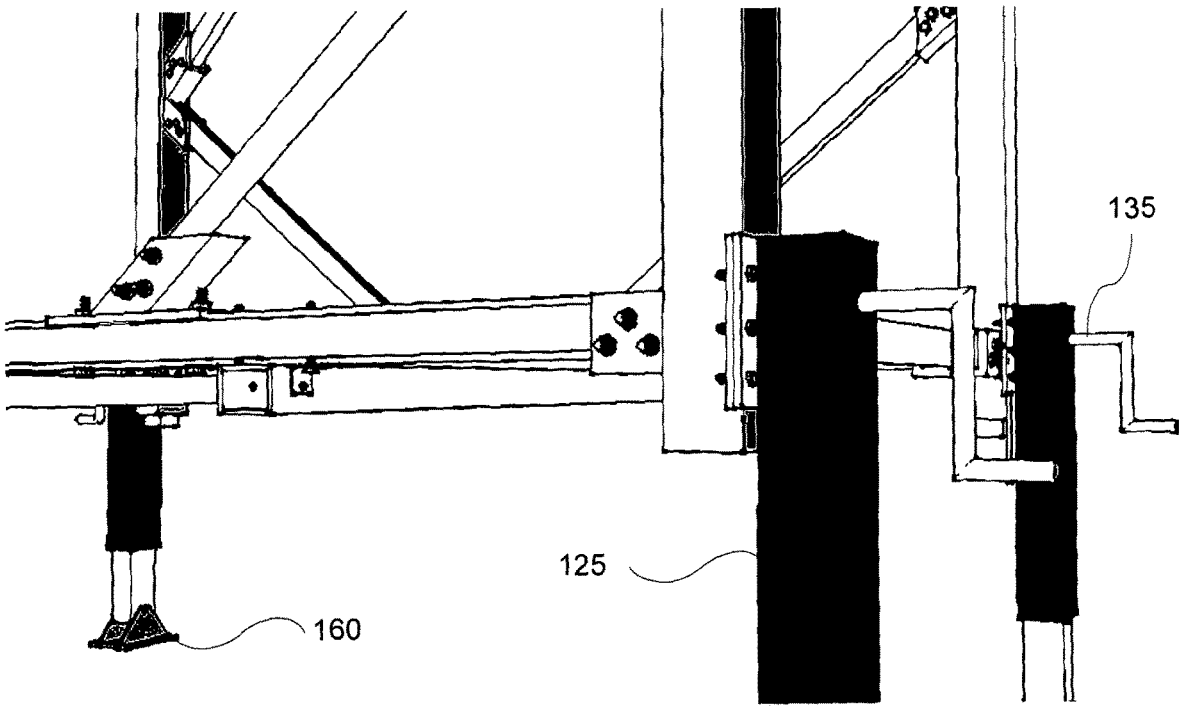
FIG. 11 shows the height adjustable landing means of the formwork support system of FIG. 1 in further detail in accordance with a preferred embodiment of the present invention.

Referring now to FIG. 9, there is shown in the lifting means engagement 120 in further detail. The embodiment given in FIG. 9, shows the lifting means engagement 120 between adjacent stacked stackable truss frames 105. The lifting means engagement 120 is preferably located at a bottom portion of the at least one stacking frame, thereby allowing the stacking frame to be lifted to the full lifting extent provided by the forklift. So as to be able to engage the forks of the forklift, the lifting means engagement 120 comprises first 120*a* and second 120*b* horizontal lifting means engagement portions. As such, in use, the forklift would be brought adjacent to the stackable truss frame 105 with the forks of the forklift in a lower position. Thereafter, the forklift would be driven towards the stackable truss frame 105 such that the forks of the forklift are engaged by the horizontal lifting means engagement portions. It should be noted that a variable number of horizontal lifting means engagement portions may be provided for the purpose of engaging forklifts having differing fork spaces. The horizontal lifting means engagement portions preferably rectangular cross-section, the cross-section been sized according to the size of the forks of the forklift.

As is apparent from the embodiment given in FIG. 9, the stackable truss frame 105 may be substantially cuboid, such that the first and second lifting means engagement portions are attached between opposing horizontal trusses of the stackable truss frame. Furthermore, the lifting means engagement portions may be located coincident to the diagonal trusses 115 of the stackable truss frame 105 for additional rigidity.

Referring to FIG. 1 again, the formwork support system 100 comprises a height adjustable landing means 110. The height adjustable landing means 110 allows the formwork support system 100 to be raised or lowered with precision so as to attain a desired height for the formwork table 150. For example, were stackable truss frames 105 having a height of 2 m used, and it was desired that the formwork table 150 should be positioned at a height of 4.5 m, two stacked stackable truss frames 105 would be employed to reach a height of 4 m, and the height adjustable landing means 110 employed to attain the extra height of 0.5. In a preferred embodiment, the height adjustable landing means 110 is adapted to provide a height of at least half the height of the stackable truss frame 105 so as to allow the formwork table 150 to reach any desired height.

Figure 8:
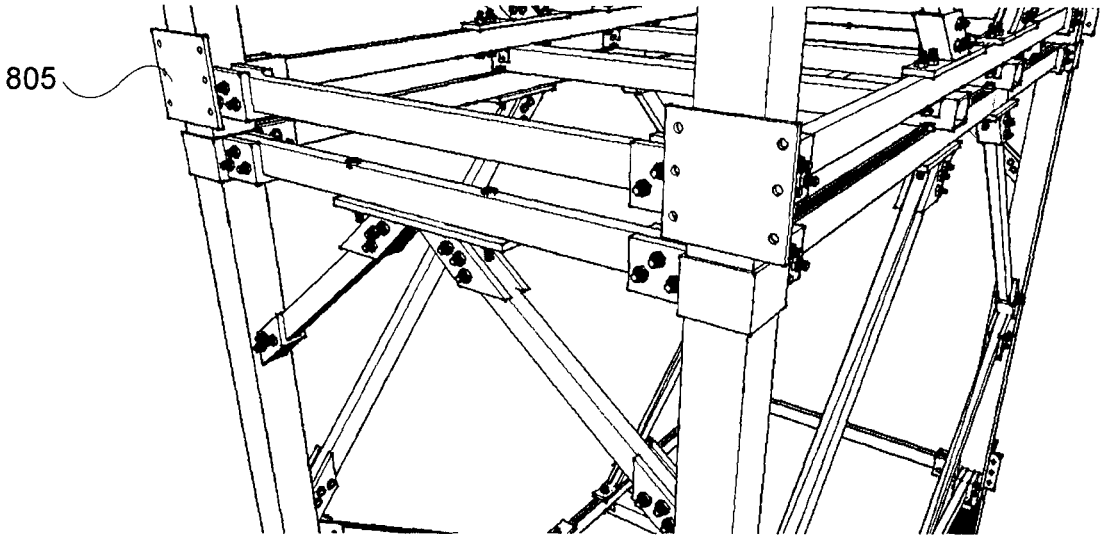
FIG. 8 shows adjacent stackable truss frames in a mechanical interlock arrangement in accordance with a preferred embodiment of the present invention.

In a preferred embodiment, the height adjustable landing means 110 is adapted to account for sloping or uneven floor surfaces. In this manner, the height adjustable landing means 110 comprises at least one height adjustable landing leg 125. Referring to FIG. 8, in one embodiment, the stackable truss frame 105 may comprise landing leg attachment means 805 for release be attaching the at least one height adjustable landing leg 125 to the stackable truss frame 105. While attachment means 805 adapted for nuts and bolt attachment is given in FIG. 8, it should be appreciated that the attachment means 805 may be attached in any manner including in a slidable mechanical interlock arrangement. The at least one height adjustable landing leg 125 is preferably telescopic so as to allow for the precise height adjustment of the height adjustable landing leg 125. Height adjustment of the height adjustable landing leg 125 may be provided by various means, such as screw sack and the like. However in a preferred embodiment, the at least one height adjustable landing leg 125 comprises a geared mechanism 130. The geared mechanism 130 allows the height of the height adjustable landing leg 125 to be adjusted without the use of substantive force provided by hammers and the like. In a preferred embodiment, the height of the height adjustable landing leg 125 is hand adjustable, and therefore comprises a winch handle 135.

In a preferred embodiment, the formwork support system 100 comprises four height adjustable landing legs 125. The four height adjustable landing legs 125 may be located to engage the vertical trusses 145 of the stackable truss frame 105. Each height adjustable landing leg 125 may be further provided with a pivotable foot 160 to account for uneven surfaces.

In a preferred embodiment, the stackable truss frame 105 comprises a complimentary mechanical interlock 140 adapted for engaging a complimentary mechanical interlock of another stackable truss frame 105 in use. The mechanical interlock 140 substantially prevents against stackable truss frames 105 in a stack from becoming dislodged under weight.

Figure 12:
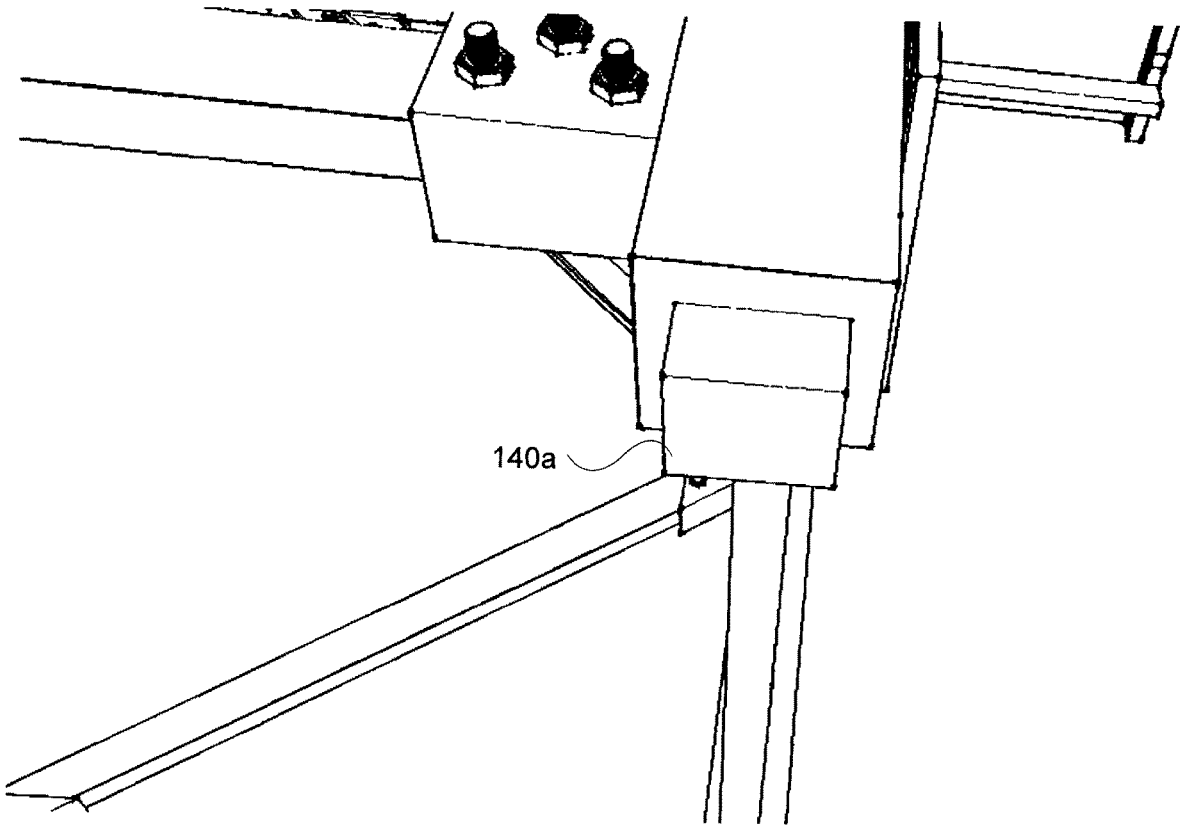
FIGS. 12 and 13 show mechanical interlock portions of the stackable truss frames of FIG. 1 in further detail in accordance with a preferred embodiment of the present invention.
Figure 13:
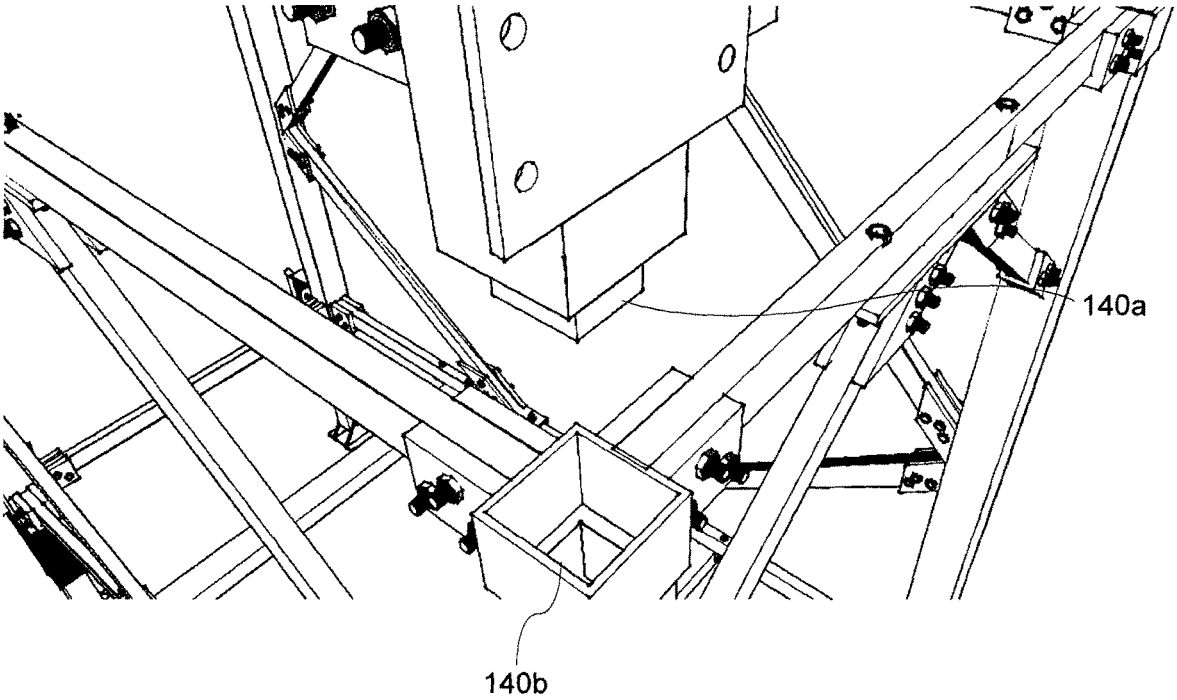

The stackable truss frame 105 comprises upper mechanical interlock portions for engaging an upper stackable truss frame 105 and lower mechanical interlock portions for engaging lower stackable truss frames 105. Referring now to FIGS. 12 and 13, there is shown the complimentary mechanical interlock 140 in further detail. Specifically, referring to FIG. 13, there is shown in the lower mechanical interlock portion 140*a* and the complimentary upper mechanical interlock portion 140*b*. Referring to FIG. 12, there is shown in the lower mechanical interlock portion 140*a*. In a preferred embodiment, the mechanical interlock comprises male and female portions such that no further attachment is necessary for the engagement, such as bolts, screws, pegs and the like. In a yet further preferred embodiment, the lower mechanical interlock portion 140*a* is a male mechanical interlock portion and the upper mechanical interlock portion 140*b* is a female mechanical interlock portion. Generally, the mechanical interlock portions 140 located adjacent the vertical trusses 145 of the stackable truss frame 105. In this manner, each stackable truss frame 105 comprises four upper mechanical interlock portions 140*b* and four lower mechanical interlock portions 140*a*.

Figure 4:
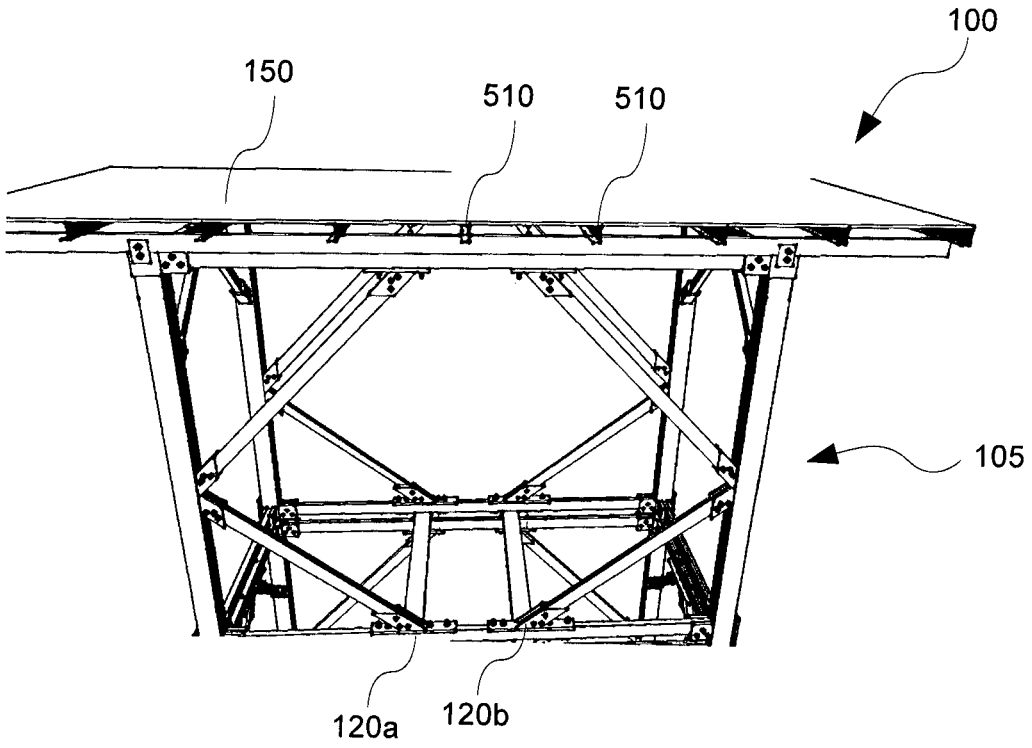
FIG. 4 shows a magnified view of the formwork support system showing a stackable truss frame and formwork table in further detail in accordance with a preferred embodiments of the present invention.

Referring again to FIG. 1, specific references on made to the formwork table 150. In use, the formwork table 150 may be attached to the stackable truss frame 105 so as to be put in place by the placement of the stackable truss frame. However, in a preferred embodiment, the formwork table 150 is adapted also for lifting by the lifting means for placement at top the stackable truss frame 105. Referring to FIG. 4, there are shown a formwork table 150 in greater detail. Specifically, as is apparent from the embodiment shown, the formwork table 150 further comprises a series of spaced apart joists 510 for rigidity. The joists 510 spaced apart in a manner so as to allow for the lifting of the formwork table 150 in use and specifically by a forklift. In this manner, the joists 510 of spaced apart so as to allow for the accommodation of the forks of the forklift. As such, in use, once a stack of stackable truss frames 105 has been erected, the formwork table 150 to be raised by a forklift and placed atop the uppermost stackable truss frame 105. Once the formwork table 150 is in place the formwork table may be secured to the uppermost stackable truss frame 105.

Method for Erecting a Formwork Support System

There is also provided a method for erecting a formwork support system 100 comprising at least one stackable truss frame 105. The method comprises engaging a lifting means engagement 120 of the at least one stackable truss frame 105 using a lifting means. In a preferred embodiment, the lifting means engagement 120 is adapted for engagement by a forklift whole offer, it should be appreciated that various lifting means may be employed depending on the application. In this manner, the lifting means is adapted to lift the stackable truss frame 105 for the purposes of forming a stack comprising two or more stackable truss frame is 105. The stack of stackable truss frame is 105 is therefore employed for the purposes of providing support for a formwork table 150 at a preferred height. In a stack in the stackable truss frames 105 an additional stackable truss frame may be placed atop a stack of stackable truss frames 105 or alternatively, a stack of stackable truss frames 105 may be raised such that an additional stackable truss frame 105 may be positioned beneath the stack.

In stacking the stacking truss frames 105, the method further comprises interlocking complimentary mechanical interlock's 140 of adjacent stackable truss frames 105. In a preferred embodiment, a stackable truss frame 105 as a male mechanical interlock portion 140*a* located at a lower portion of the stackable truss frame 105 and a female mechanical interlock portion 140*b* located at an upper portion of the stackable truss frame 105. In this manner, the method further comprises bringing the mechanical interlock portions 140*b* of adjacent stackable truss frames 105 together so as to form a mechanical interlock.

In order to attain precise height adjustment, the method further comprises adjusting the height of a height adjustable landing means 110 of the formwork support system 100. In a preferred embodiment, the height adjustable landing means 110 comprises at least one height adjustable landing leg 125. Preferably, the at least one height adjustable landing leg comprises a geared mechanism 130 for the purposes of adjusting the height of the height adjustable landing leg 125. As such, the method further comprises adjusting the height of at least one height adjustable landing leg 125, preferably by hand, such as by using a winch handle 135 or the like.

Once at least one stackable truss frame 105 and the height adjustable landing means 110 have been configured in this manner, the method further comprises providing a formwork table 150 atop the uppermost stackable truss frame 105 for the purposes of supporting formwork. In one manner, the uppermost stackable truss frame 105 may be raised into place with the formwork table 150 attached, alternatively, the formwork table 150 may be attached to the uppermost stackable truss frame 105 wherein the uppermost stackable truss frame 105 is in place. In this manner, the formwork table 105 comprises one or more spaced apart joists 510 spaced apart in a manner to accommodate forks on a forklift. Such joists 510 were shown in further detail in FIG. 5. As such, the method further comprises raising a formwork table 150 atop the uppermost stackable truss frame 105 and fastening the formwork table 150 to the uppermost stackable truss frame 105.

Once an intermediate floor has been formed, the method further comprises deconstructing the formwork support system 100 for relocation to the next upper floor. Such deconstruction may comprise the disengagement of the mechanical interlock's 140 of adjacent stackable truss frames 105 and transportation of stackable truss frames 105 to the next upper floor.

The invention claimed is:

1. A method for erecting a construction formwork support system comprising a first stackable truss frame and a second stackable truss frame that are configured for construction formwork support, each of the first and the second stackable truss frame comprising a first pair of vertical trusses, a second pair of vertical trusses, a first horizontal truss connected between the first pair of vertical trusses, a second horizontal truss connected between the second pair of vertical trusses, a first diagonal bracing truss having a first end connected to the first horizontal truss and a second end connected to one of the first pair of vertical trusses, a second diagonal bracing truss having a first end connected to the second horizontal truss and a second end connected to one of the second pair of vertical trusses; and a lifting means engagement connected between the first horizontal truss and the second horizontal truss such that the lifting means engagement is coincident to the first end of each of the first diagonal bracing truss and the second diagonal bracing truss, the method comprising:

engaging the lifting means engagement of the first stackable truss frame using a lifting means; and lifting the first stackable truss frame, so as to stack it on the second stackable truss frame, wherein the lifting means engagement is adapted for allowing direct lateral engagement of the lifting means during the engaging step.

2. The method according to claim 1, wherein the first stackable truss frame is stacked on top of the second stackable truss frame after the lifting step to form a formwork support system of a specific height.

3. The method according to claim 1 or 2, wherein the lifting means is adapted to lift at least another stackable truss frame to stack it on the first stackable truss frame for the purpose of forming a stack comprising three or more stackable truss frames.

4. The method according to claim 2, wherein the method further comprises the step of adjusting the height of the resulting formwork support system using a height adjustable landing means.

5. The method according to claim 1, wherein the method further comprises the step of providing a formwork table atop the uppermost stackable truss frame.

6. The method according to claim 5, wherein the formwork table comprises joists spaced apart so as to allow for engagement by a lifting means in use.

7. The method according to claim 6 wherein the spaced apart joists are spaced apart in a manner to accommodate forks on a forklift in use.

8. The method according to claim 1, wherein the first stackable truss frame is of a different height relative to the second stackable truss frame.

9. The method according to claim 4, wherein the height adjustable landing means is adapted to account for sloping or uneven floor surfaces.

10. A construction formwork support system comprising:

at least one stackable truss frame that is configured for construction formwork support, each of the at least one stackable truss frame comprises:

a first pair of vertical trusses, a second pair of vertical trusses, a first horizontal truss connected between the first pair of vertical trusses, a second horizontal truss connected between the second pair of vertical trusses, a first diagonal bracing truss having a first end connected to the first horizontal truss and a second end connected to one of the first pair of vertical trusses, a second diagonal bracing truss having a first end connected to the second horizontal truss and a second end connected to one of the second pair of vertical trusses; and a lifting means engagement connected between the first horizontal truss and the second horizontal truss such that the lifting means engagement is coincident to the first end of each of the first diagonal bracing truss and the second diagonal bracing truss, wherein, in use, the lifting means engagement is adapted for engaging a lifting means so as to allow a first stackable truss frame of the at least one stackable truss frame to be lifted by the lifting means for stacking on a second stackable truss frame of the at least one stackable truss frame, and wherein the lifting means engagement is adapted for allowing direct lateral engagement of the lifting means in use.

11. The formwork support system as claimed in claim 10, wherein the lifting means engagement is adapted for engaging forks of a forklift in use.

12. The formwork support system as claimed in claim 10, further comprising a height adjustable landing means adapted to engage the at least one stackable truss frame, wherein the height adjustable landing means is configurable between a lowered configuration and a raised configuration.

13. The formwork support system as claimed in claim 10, wherein each stackable truss frame further comprises a complimentary mechanical interlock adapted for engaging another complimentary mechanical interlock of another stackable truss frame in use.

14. The formwork support system as claimed in claim 13, wherein the complimentary mechanical interlock is adapted for a male and female mechanical interlock.

15. The formwork support system as claimed in claim 10, further comprising a formwork table adapted for engaging the at least one stackable truss frame.

16. The formwork support system as claimed in claim 15, wherein the formwork table comprises joists spaced apart so as to allow for lifting means engagement.

17. The formwork support system as claimed in claim 12, wherein each stackable truss frame further comprises a complimentary mechanical interlock adapted for engaging another complimentary mechanical interlock of another stackable truss frame in use.

18. The formwork support system as claimed in claim 17, further comprising a formwork table adapted for engaging the at least one stackable truss frame.

19. The formwork support system as claimed in claim 10, wherein when the first stackable truss frame is stacked on the second stackable truss frame, the lifting means engagement of the first stackable truss frame is adjacent the second stackable truss frame.

* * * * *